US009517866B2

(12) United States Patent
Coffey et al.

(10) Patent No.: US 9,517,866 B2
(45) Date of Patent: Dec. 13, 2016

(54) CLOSURE SYSTEM FOR CONTAINERS

(71) Applicant: HeatGenie, Inc., Austin, TX (US)

(72) Inventors: Brendan Coffey, Austin, TX (US); William L. Warrenburg, Austin, TX (US)

(73) Assignee: HeatGenie, Inc., Austin, TX (US)

( * ) Notice: Subject to any disclaimer, the term of this patent is extended or adjusted under 35 U.S.C. 154(b) by 0 days.

(21) Appl. No.: 15/019,784

(22) Filed: Feb. 9, 2016

(65) Prior Publication Data

US 2016/0229598 A1 Aug. 11, 2016

Related U.S. Application Data

(60) Provisional application No. 62/113,850, filed on Feb. 9, 2015, provisional application No. 62/149,825, filed on Apr. 20, 2015.

(51) Int. Cl.
*B65D 17/50* (2006.01)
*B65D 43/20* (2006.01)
(Continued)

(52) U.S. Cl.
CPC ..... *B65D 43/20* (2013.01); *B65D 17/16* (2013.01); *B65D 17/165* (2013.01);
(Continued)

(58) Field of Classification Search
CPC ..... B65D 43/267; B65D 51/18; B65D 43/265; B65D 47/265; B65D 43/20; B65D 17/16
(Continued)

(56) References Cited

U.S. PATENT DOCUMENTS 3,664,543 A 5/1972 Brown et al.
3,731,836 A 5/1973 Silver
(Continued)

FOREIGN PATENT DOCUMENTS

DE 102012023131 A1 12/2013
EP 2300328 A1 3/2011
(Continued)

OTHER PUBLICATIONS

"Why Didn't I Think of That?: Resealable Can", www.geekology.com, Jan. 22, 2016.
(Continued)

*Primary Examiner* — Anthony Stashick
*Assistant Examiner* — Raven Collins
(74) *Attorney, Agent, or Firm* — DuBois, Bryant & Campbell LLP; William D. Wiese

(57) ABSTRACT

An improved easy opening closure wherein a cover panel is bonded to a container end panel around the perimeter of an aperture through the end panel. A rotating lever is connected to a proximal lever through a rivet acting as a fulcrum such that, as pressure is applied to rotate the rotating lever axially around the rivet, the force is magnified which allows the proximal lever selectively debonds an isolated region of the perimeter, thereby allowing pressure within the container to escape. Continued rotation of the rotating lever further debonds the cover panel from the end panel. The leading edge of the rotating lever wedges between the end panel and the cover panel at the opposite edge of the aperture, thereby cleaving and debonding the connection between the panels at that edge.

25 Claims, 15 Drawing Sheets

(51) Int. Cl.
*B65D 17/00* (2006.01)
*B65D 51/16* (2006.01)

(52) U.S. Cl.
CPC ..... *B65D 17/166* (2013.01); *B65D 51/1688* (2013.01); *B65D 2517/002* (2013.01); *B65D 2517/0025* (2013.01); *B65D 2517/0031* (2013.01); *B65D 2517/0034* (2013.01); *B65D 2517/0043* (2013.01)

(58) Field of Classification Search
USPC ..... 220/260
IPC ..... B65D 43/267,51/18, 43/265, 47/265, 43/20, 17/16
See application file for complete search history.

(56) References Cited

U.S. PATENT DOCUMENTS

| | | | |
|---|---|---|---|
| 4,077,538 | A | 3/1978 | Waterbury |
| 4,122,970 | A | 10/1978 | Amabili |
| 4,234,099 | A | 11/1980 | Tarro |
| 4,361,249 | A | 11/1982 | Tuneski et al. |
| 4,442,950 | A | 4/1984 | Wilson |
| 4,605,141 | A | 8/1986 | Won |
| 5,285,924 | A | 2/1994 | Morris |
| 5,752,614 | A | 5/1998 | Nelson et al. |
| 6,220,470 | B1 | 4/2001 | McHenry et al. |
| 6,626,314 | B1 | 9/2003 | McHenry et al. |
| 7,823,740 | B2 | 11/2010 | Perra |
| 7,918,359 | B2 | 4/2011 | Paris et al. |
| 8,240,498 | B2 | 8/2012 | Ramsey et al. |
| 8,336,725 | B2 | 12/2012 | Ramsey et al. |
| 8,469,218 | B2 | 6/2013 | Bratsch |
| 8,720,717 | B2 | 5/2014 | Kaanta et al. |
| 8,794,469 | B2 | 8/2014 | Bratsch |
| 2002/0050493 | A1 | 5/2002 | Ball et al. |
| 2003/0000952 | A1 | 1/2003 | Dyren |
| 2004/0256388 | A1 | 12/2004 | Rossetti et al. |
| 2005/0051553 | A1 | 3/2005 | Li et al. |
| 2006/0261068 | A1* | 11/2006 | Schmidtner ..... B65D 43/0208 220/254.9 |
| 2007/0131690 | A1 | 6/2007 | Nadal |
| 2007/0145055 | A1 | 6/2007 | Gardiner |
| 2007/0164026 | A1 | 7/2007 | Morrissey et al. |
| 2007/0215620 | A1 | 9/2007 | Kasper |
| 2009/0173737 | A1 | 7/2009 | Ramsey et al. |
| 2009/0314777 | A1 | 12/2009 | Gross et al. |
| 2013/0180985 | A1* | 7/2013 | Damaghi ..... B65D 81/22 220/200 |
| 2013/0206766 | A1 | 8/2013 | Ramsey et al. |
| 2013/0320012 | A1 | 12/2013 | Lucas |
| 2015/0060450 | A1 | 3/2015 | Phillips |
| 2015/0375910 | A1 | 12/2015 | Bissu |

FOREIGN PATENT DOCUMENTS

| | | | |
|---|---|---|---|
| KR | 20-1991-0006503 | Y1 | 8/1991 |
| KR | 10-2011-0023382 | A | 3/2011 |
| NL | 1008675 | C2 | 3/1999 |
| WO | 02081322 | A1 | 10/2002 |

OTHER PUBLICATIONS

Ian Cunningham, "Monster Energy Launches Resealable Cans", www.drinkdaily.com, Jan. 22, 2016.
Ross Brooks, "Resealable Soda Can Lets People Drink Spill-Free", www.psfk.com, Oct. 4, 2013.
"The can2close solution", www.can2close.com, May 21, 2008.
International Search Report and Written Opinion issued in corresponding international application No. PCT/US2016/017392.

* cited by examiner

CLOSURE SYSTEM FOR CONTAINERS

PRIORITY STATEMENT UNDER 35 U.S.C. §119 & 37 C.F.R. §1.78

This non-provisional application claims priority based upon prior U.S. Provisional Patent Application Ser. No. 62/113,850 filed Feb. 9, 2015 in the name of Brendan Coffey entitled "Closure System for Containers," and U.S. Provisional Patent Application Ser. No. 62/149,825 filed Apr. 20, 2015 in the name of Brendan Coffey and Krzysztof Kwiatkowski entitled "Thermally Regulated Self-Heating Containers," the disclosures of each of which are incorporated herein in their entirety by reference as if fully set forth herein.

BACKGROUND

Metal cans are a common form of packaging for food and beverage that offer numerous advantages when compared to other material packaging forms, including metal's ability to be hermetically sealed for long storage, its low cost, and its excellent recyclability. "Easy opening" metal food containers which, for purposes of this disclosure include opening systems that do not require a separate can opening tool to access the contents, offer even greater consumer convenience for many packaged products. Two common systems for providing easy opening functionality are "Stay on Tab" (SOT) systems and peel-seam systems.

SOT easy opening systems, such as those described in U.S. Pat. No. 3,731,836, score a line in the container end panel to outline a weakened opening area and use the leverage of a rivet-retained tab to take advantage of the weakened score line to push the opening area through the end panel. As the name suggests, the tab remains affixed to the end panel after opening.

Partial aperture pour openings in beverage containers are well known in the art. In some instances, the score line does not create a fully contiguous opening within the end of the panel so that, after the opening is pushed through the end panel, the area within the scored line remains connected to the end panel.

The SOT was an improvement over earlier forms of easy opening end panel systems such as those described in U.S. Pat. No. 3,664,543 wherein the scored tab was completely removable from the end panel and often discarded indiscriminately, thereby creating consumer safety and litter problems. Thus, it is well recognized that loose tabs are not acceptable to consumers in easy opening container end panels.

In some cases, SOT design principles have also been extended to produce full aperture easy opening ends for metal food cans and other containers. In these applications, the score line is now fully contiguous around the removable end panel to which the tab lever is joined.

Although there have been improvements to SOT container ends, there are some inherent disadvantages to scored openings that are forced open through the lever action of a tab. For example, it can be difficult to access and grip the tab, often resulting in broken finger nails or injury to a fingertip, and it can be difficult for a consumer to less than optimal ease of opening as the tab can be difficult for consumers. Even when the tab can be accessed, the force required to initiate the opening of the can and release the pressure inside the can is often too great for many consumers to apply. If the consumer is able to open the can, they are then exposed to the sharp edges inherent to the score line break, and, to top it off, these type of opening systems do not lend themselves to reclosing since the score line break deforms the freed panel in a way that is not readily reversed.

Peel-seam systems as exemplified by U.S. Pat. No. 5,752,614 can also be used for easy-opening closures on hermetically sealed containers. A bounded aperture, often in the form of a flattened circular rim, is covered by a membrane typically comprised of a tear-resistant metal foil/polymer laminate that extends over the opening and its periphery. The container is sealed by a continuous loop of food safe adhesive applied between the overlapping edges of the membrane and the container wall. The adhesive is selected to give a bond with sufficient shear and tensile strength to hold up in filling, processing, and storage conditions, yet a low enough peel strength to enable easy-opening of the container.

Directional pull by a consumer on an edge tab of the membrane stresses the adhesive bond in peel mode, and continuing this motion progressively overcomes the total bonding force of the adhesive around the full perimeter. However the detached membrane loses its adhesive character and curls and distorts and is not a useful structure for reclosing.

There is a need, therefore, for a container opening system with a tab or lever that is easy to access and grip and that, when used in connection with pressurized containers, does not require inordinate force to release the pressure inside the container. In addition, there is a need for a container that provides the convenience to consumers of reduced spillage or contamination of contents after the container has been opened. The need extends to a container opening system that, once opened, does not expose the user to sharp edges around the aperture and further allows reclosing of the container in a way that is readily reversed.

SUMMARY

Various embodiments of the present invention include opening systems in a container end panel having a cover panel that covers, but is larger in area than, an aperture through the end panel. The cover panel can be bonded to the end panel around the perimeter of the cover panel. A rotatable lever is interposed between the end panel and cover panel. The lever is bonded at one end to the end panel and the cover panel through a rivet or other structural element. When assembled into the closure, the rotatable lever shares a common plane with the bonded perimeter but does not interfere with the bond seal in its initially assembled rest position.

To open the closure system, a user applies force to the rotating lever to move it axially around the attachment from its initial storage position against a first edge of the aperture. The axial rotation is continued until the movement of the rotating lever abuts against the opposite or second edge of the aperture. At this point of travel, the bond between the end panel and the cover panel has been broken along substantially all of the bond perimeter and the cover panel has been irreversibly affixed to the rotating lever.

At this point, when the rotating lever is positioned against the second edge, reversing the rotation of the rotating lever causes the latched cover panel to axially rotate with the rotating lever, progressively uncovering the aperture as the rotating lever and the cover panel are rotated until such time as the aperture is fully open at the point when the rotating lever returns to the first edge. Thereafter, because the rotating lever is affixed to the cover panel, the rotating lever can be moved from the first edge to the second edge and back to reversibly close and open the aperture.

When container opening systems are used in connection with pressurized containers, it is necessary to first relieve the pressure in the container by selectively debonding the cover panel from the end panel in an isolated location. Certain embodiments of the present invention provide a rotating lever configured with a proximal lever whereby, when the rotation described above is initiated, the proximal lever is first wedged between the end panel and the cover panel in the area adjacent to the structural element described above, forcing the two panels apart and debonding an isolated area. In this instance, the rotating lever and the proximal lever form a mechanical lever that pivots on the structural element creating a fulcrum. Because the distance from the point at which the force is applied to the rotating lever from the fulcrum is greater than the distance from the fulcrum to the point at which the proximal lever is wedged between the end panel and the cover panel, the force applied by the user to the rotating lever is significantly magnified making is substantially easier for the user to release the pressure in the container.

The foregoing has outlined rather broadly certain aspects of the present invention in order that the detailed description of the invention that follows may better be understood. Additional features and advantages of the invention will be described hereinafter which form the subject of the claims of the invention. It should be appreciated by those skilled in the art that the conception and specific embodiment disclosed may be readily utilized as a basis for modifying or designing other structures or processes for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENTS

The present invention is directed to improved methods and systems for, among other things, reclosable container opening systems. The configuration and use of the presently preferred embodiments are discussed in detail below. It should be appreciated, however, that the present invention provides many applicable inventive concepts that can be embodied in a wide variety of contexts other than reclosable container opening systems. Accordingly, the specific embodiments discussed are merely illustrative of specific ways to make and use the invention, and do not limit the scope of the invention.

Embodiments of the present invention pertain to a closure for a container, wherein the container has a substantially planar end panel with an aperture therethrough and, within the perimeter of the end panel, a separate and movable interior panel with an extended edge or flange area that covers the aperture and overlaps the boundary around it, the interior panel being initially fixed in place and sealed to the end panel by an adhesive, ultrasonic weld, or other means of bonding, and a moveable tool used to facilitate easy opening and progressively debond the interior panel from the end panel thereby rendering it moveable in relation to the end panel. In certain embodiments, the interior panel may also reclose and either partially or entirely seal the aperture.

Figure 1A:
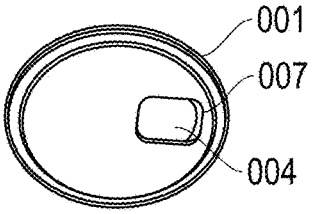
FIGS. 1A and 1C show upper views and FIGS. 1B and 1D show lower views, of one embodiment of a sliding container closure end of the present invention.
Figure 1B:
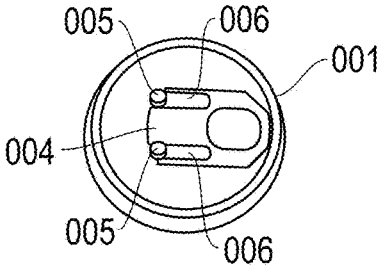
Figure 1C:
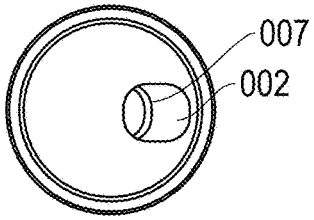

Referring now to FIGS. 1A, 1B, 1C and 1D, which depict one embodiment of a container closure, comprising an end panel 001 in the form of a seamable beverage can end with a through opening 002 to form a pour spout into which a separate and movable shaped aperture cover panel 004 is positioned. FIGS. 1A and 1C show the top surface of the end panel 001 with the aperture cover panel 004 in open and closed positions respectively. The aperture cover panel 004 protrudes from the end panel 001 surface with a raised handle 007 for user actuation. The end panel 001 may be formed from materials known in the art such as, for example, aluminum sheet.

Figure 1D:
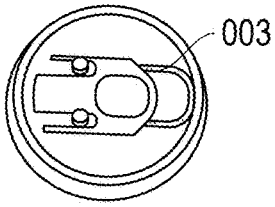

FIGS. 1B and 1D show the underside of the end panel 001 from which it is apparent that aperture cover panel 004 is larger in area than the through opening 002. The aperture cover panel 004 may be loosely retained and guided through its opening movements by rivet structures 005 projecting from the underside of the end panel 001 and through slotted channels 006 in the aperture cover panel 004. Methods of forming rivet structures 005 are well known in the art. In certain embodiments, a hermetic seal is created between the end panel 001 and the aperture cover panel 004 by applying a continuous loop of hot melt adhesive between the end panel 001 and the aperture cover panel 004 in the cover panel flange perimeter 003.

Figure 2A:
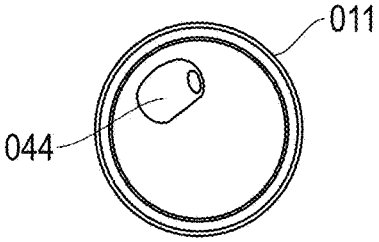
FIGS. 2A and 2C show upper views and FIGS. 2B and 2D show lower views, of one embodiment of a rotating container closure end of the present invention.
Figure 2B:
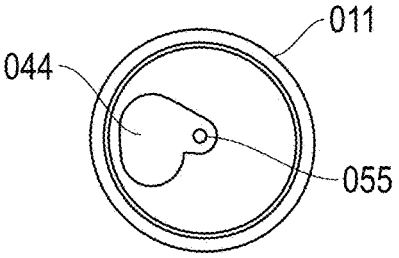
Figure 2C:
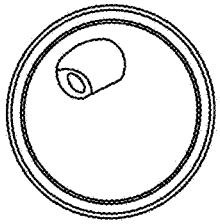

Referring now to FIGS. 2A, 2B, 2C and 2D which depict another embodiment of a container closure, comprising an end panel 011 in the form of a seamable container end with a through opening to form a pour spout into which a separate and movable shaped aperture cover panel 044 is positioned. FIGS. 2A and 2C show the top surface of the end panel 011 with the aperture cover panel 044 in open and closed positions respectively. In certain embodiments, the aperture cover panel 044 protrudes from the end panel 011 with a raised handle for user actuation.

Figure 2D:
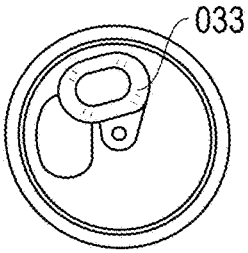

FIGS. 2B and 2D show the underside of the end panel 011 from which it is seen that aperture cover panel 044 is larger in area than the through opening. The aperture cover panel 044 may be loosely retained to the end panel 011, such as by a central rivet projecting from the underside of the end panel 011 and through a small circular hole in the aperture cover panel 044 or by other attachments known in the art, so that the aperture cover panel 044 is permitted to rotate to cover, and alternatively expose, the through opening. The end panel 011 and the aperture cover panel 044 may be hermetically sealed together by, for example, applying a continuous loop of hot melt adhesive between them beneath the flange perimeter 033 of the aperture cover panel 044.

The foregoing embodiments provide a hermetically sealed and reclosable sealed container. However, in both cases the full perimeter of the seal area must first be disrupted to initiate movement of the aperture cover that could require substantial applied force to spontaneously achieve. For everyday use by an average consumer, the peak applied force required to open an easy-opening container should be less than 5-10 lbf.

Figure 3A:
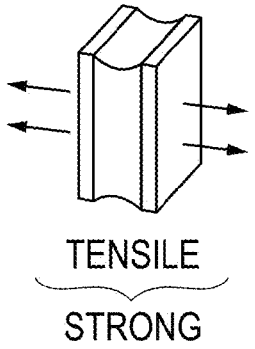
FIGS. 3A, 3B, 3C, 3D and 3E show adhesive stress modes relevant to various embodiments of the present invention.
Figure 3B:
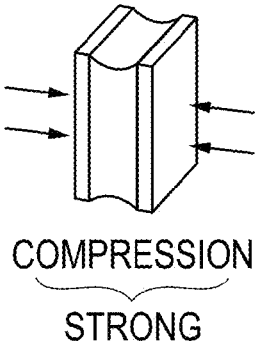
Figure 3C:
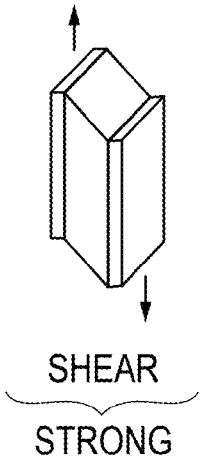
Figure 3D:
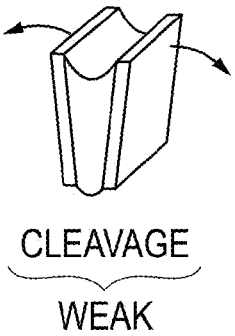
Figure 3E:
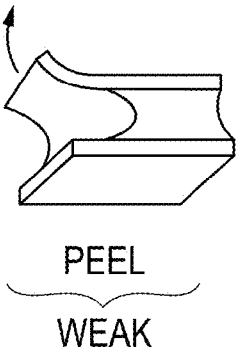

FIGS. 3A through 3F shows the five stress modes to which adhesively bonded joints may be subjected (often in combination) in practical use. Adhesives are strongest in tensile loading (FIG. 3A), compression loading (FIG. 3B) and shear loading (FIG. 3C), and they are weakest under cleavage loading (FIG. 3D) and peel loading (FIG. 3E). The two latter modes concentrate the applied force into a single line of high stress at the edge of a joint making it susceptible to failure. Thus, for maximum strength, a bonded joint is typically designed so that the loading stresses are directed along the lines of the adhesive's greatest strengths, and the potential for cleavage and peel stresses to occur is minimized. But, by design, peel seam systems for food containers take advantage of the substantial difference in strength between loading modes. For example, a typical peel seam adhesive bond has a shear force strength of greater than 15 psi providing a strong seal for loads that occur during processing and storage of the container, while the pulling force needed to peel the adhesive seam is only about 2 to 4 psi.

Note that it is the thin and highly flexible nature of the covering membrane that enables a user to stress the seam in peel mode. If a container having a peel seam opening is subject to significant internal pressure, a thin membrane cover may bulge over the aperture thereby exerting a peel force on the heat seal that then fails. Closures for carbonated beverages must be capable of withstanding internal pressures of at least 90 psi. Peel seam closures are not well suited for this application since increasing the shear strength of the adhesive sufficiently to withstand pressure would make manual peeling of the closure nearly impossible.

Figure 4:
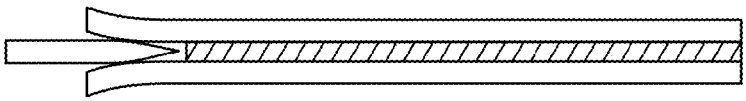
FIG. 4 shows a cleave seam relevant to various embodiments of the present invention.

Cleavage stresses applied perpendicular to the bond line represent the most severe form of loading that can be applied to a bonded joint. Forcing a wedge into the bond line of a flat-bonded specimen as shown in FIG. 4 creates cleavage stresses at the crack tip. The wedge imposes a fixed displacement to the adherends (substrate "arms") and energy stored in bending the adherends provides driving force for further crack growth. Wedge cleavage of an adhesively bonded joint as shown in FIG. 4 requires rigid adherends with minimal tendency to deform.

In the various embodiments of the invention described herein, the design of the bond joint, the adhesive selection, the mechanism by which the seal is de-bonded, and mechanical advantage of the movable tool provide for a good seal for storage yet with low force requirement for opening. By design, various embodiments are configured to cleave the bond between the cover panel and the end panel. In these embodiments, the aperture cover and end panel are of sufficient material thickness and structural design to mitigate flexing. The end panel may, for example, be stamped from an AA5182 aluminum alloy sheet of 0.2 to 0.3 mm thick. The aperture cover may be formed from the same material, from a somewhat thicker part molded from a food grade plastic material, or from other materials known in the art.

In various embodiments, a lever or tool is movably attached to an end panel and a cover panel and positioned to debond the bond therebetween. The lever or tool is accessible to the user who moves the lever or tool, which is sometimes configured with a handle or tab for convenience and/or leverage, in such a manner that an edge of the lever or tool is interposed between the seam between the cover panel and the end panel creating mechanical advantage to concentrate force at various points along its travel path, thereby apportioning the force and energy needed to fully debond the seam.

For container openings having cleave seam seals, a useful starting point for the bond joint and adhesive selection can be derived from peel seam systems. There are a variety of food-safe adhesives in commercial use strong enough to withstand the temperature and pressures associated with food processing. They are suitably chemically resistant with good barrier properties in different environments so as to provide a hermetic seal to the container. Practical methods to apply them to form a simple lap joint between container and lid are well known in the art. For example, heat-sealable polypropylene is one common material, but many others can be used. Single lap joints of 1.5 to 4 mm in width around the aperture perimeter provide a suitable joint geometry. Spot or ultrasonic micro-welds along the bond length can be used in combination with the adhesive to provide additional reinforcement.

Figure 5A:
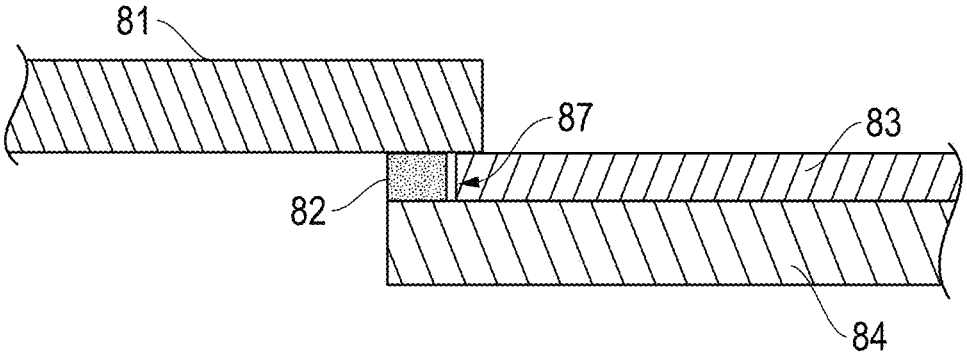
FIGS. 5A and 5B show the working edge of a moveable tool inherent to certain embodiments of a container opening of the present invention.
Figure 5B:
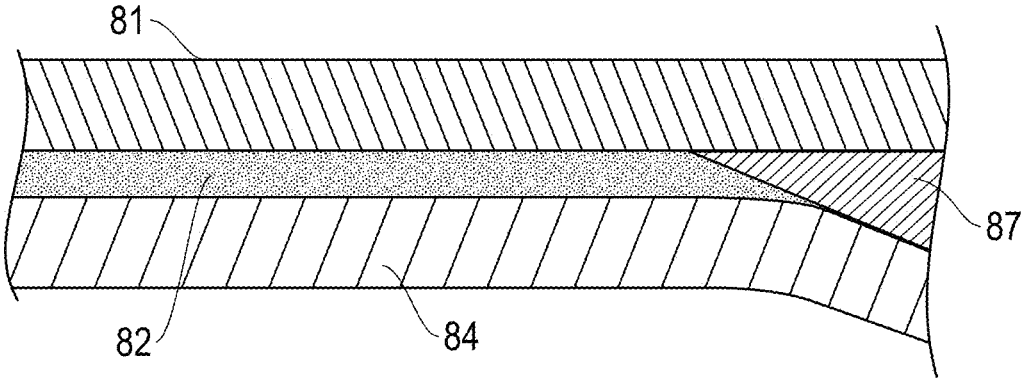

FIGS. 5A and 5B show diagrammatically one possible configuration wherein a working edge 87 of a moveable tool 83 is interposed in the gap between the closure end panel 81 and an aperture cover panel 84 positioned beneath it. FIG. 5A shows a section view looking across the joint. End panel 81 projects in from the can edge from the left side and the aperture cover panel 84 and movable tool 83 project in from the rivet around which they pivot off from the right side. The bond seam 82 could be, for example, a polypropylene hot melt adhesive 2 mm wide and 0.02 mm thick, with the end panel 81, the moveable tool 83 and the aperture cover panel 84 formed from 0.25 mm thick aluminum. In some embodiments, the edge of the end panel 81 overhangs the aperture cover panel 84 by 4 mm with the lap joint at the leftmost boundary of the overlap region. There is thus an adhesive free region of the overlap into which the tool edge 87 is free to move without contacting or shearing the adhesive. FIG. 5B is a diagram of the same region looking along the seam. From this perspective the working edge of the moveable tool 83 has a wedged shape that provides mechanical advantage to facilitate its movement along the seam. The moveable tool 83 can thus cleave and progressively debond the joined panels, forcing them apart as it moves forward along the seam and straining the adhesive joint between the two panels beyond its maximum elongation. Given the inherent properties of many adhesives known in the art, the cover panel and the end panel undergo minimal deformation as a result of the cleaving of the seam, and the two panels maintain or regain their shape after the tool has cleaved the seam.

The following additional example embodiments will further illustrate the arrangement described above as well as some alternative possible arrangements. For example, stress modes in addition to cleaving the bond may be applied to the bond joint. There may be more than a single working edge associated with the moveable tool. There may also be alternative means of providing mechanical advantage to applied force for example using a rivet to act as fulcrum for a lever tab.

Figure 6:
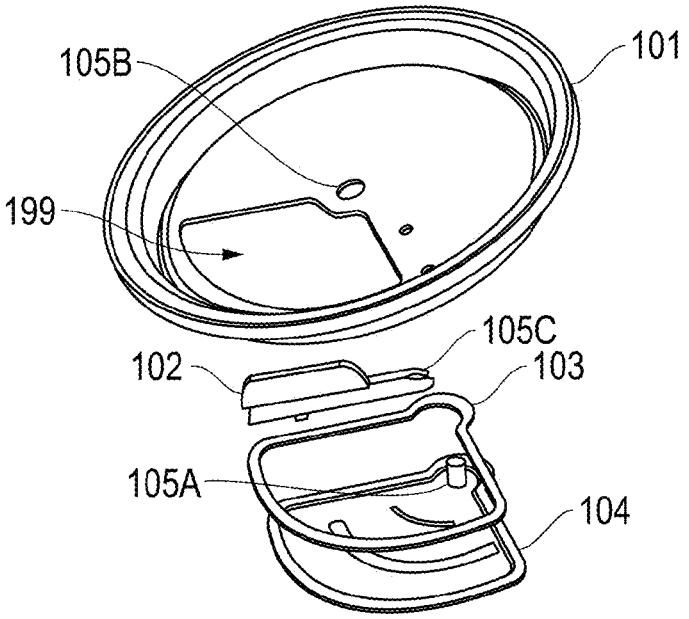
FIG. 6 shows an exploded view of one embodiment of a rotating container closure of the present invention.

FIGS. 6 through 15 are various views of other embodiments of container closures of the present invention. Referring now to FIG. 6 which shows an exploded view of the separate components of one embodiment of a container closure system prior to assembly. The end panel 101 is a seamable container end with a generally wedge shaped aperture 199 to form a pour spout or otherwise provide access to the container's contents. In this example, the end panel 101 also has a small through hole 105B at its center.

A separate shaped cover panel 104 that is larger in area than the aperture 199, and thus can be used as a cover for the aperture 199, has, in some embodiments, a rivet preform structure 105A in the form of a hollow closed end cylinder, facing the bottom of the end panel. During assembly of the closure, the cover panel can be bonded to the end panel 101 in the bond perimeter 103 such as, for example through the use of a continuous loop of hot melt adhesive.

Figure 12:
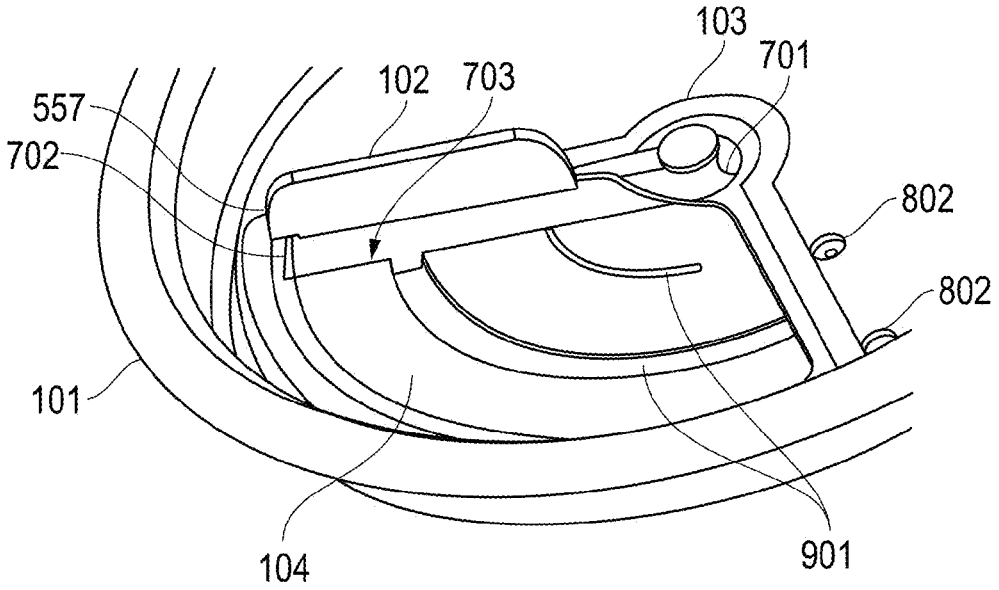
FIG. 12 shows a cutaway view of the same embodiment of a rotating container closure of the present invention.
Figure 13:
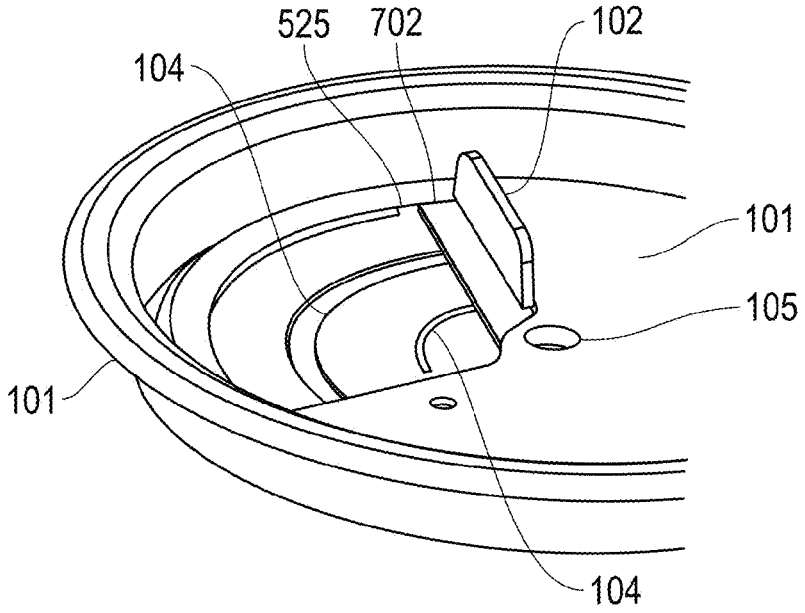
FIG. 13 shows a top view of the same embodiment of a rotating container closure of the present invention from a side perspective.

A tabbed rotatable lever 102 is interposed between the end panel 101 and cover panel 104. The lever 102 also has a small through hole 105C at one end. When assembled into the closure, the lever 102 shares a common plane with the bonded perimeter 103 but does not interfere with the bond seal in its initially assembled rest position (as can be seen in FIGS. 12 and 13). However the lever 102 is configured such that when operated it will apply force to disrupt the adhesive bond located in the bond perimeter 103 between the end panel 101 and the cover panel 104. For efficiency, the lever 102 could be formed from the material removed from the end panel 101 to create the aperture 199.

The diameter of the rivet preform structure 105A is slightly smaller than that of the through holes 105B and 105C. These features are mating components to join and provide a pivot for the end and interior panels of the closure system. Methods of forming a rivet joint are well know in the art, for example, joining a tab to the end panel of an SOT closure.

Figure 7:
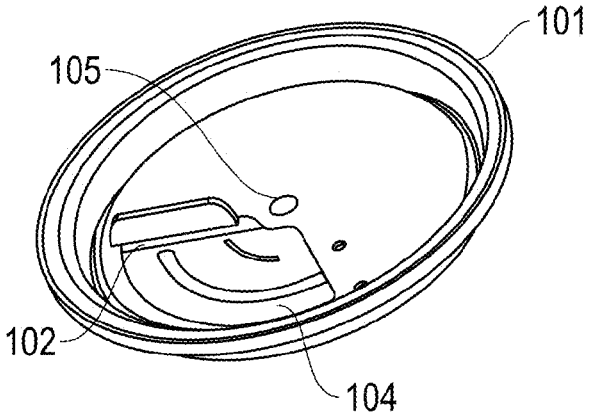
FIG. 7 shows a top view of the same embodiment of a sealed rotating container closure of the present invention.

Referring now to FIG. 7 which shows a top view of the closure system assembled from the components of FIG. 6. The flattened rivet preform structure 105A, when inserted through holes 105B and 105C, keeps the end panel 101, cover panel 104, and lever 102 together throughout storage and use of the closure system. On opening the closure system, one surface of the adhesive seal in the bond perimeter 103 (not visible in FIG. 4) remains bonded to the end panel 101 or the cover panel 104, thereby eliminating any loose materials or parts.

Figure 8:
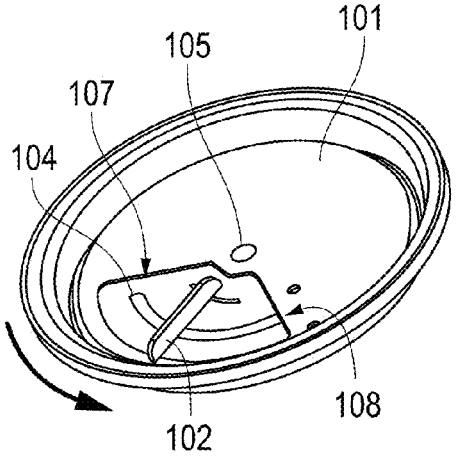
FIG. 8 shows a top view of the same embodiment of a rotating container closure of the present invention in a state of partial debonding.
Figure 9:
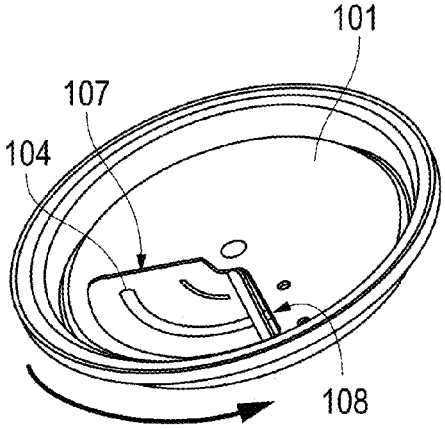
FIG. 9 shows a top view of the same embodiment of a rotating container closure of the present invention in a state of advanced debonding.
Figure 10:
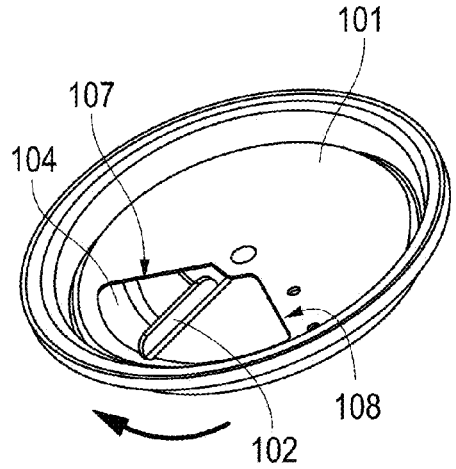
FIG. 10 shows a top view of the same embodiment of a rotating container closure of the present invention in a partially opened configuration.
Figure 11:
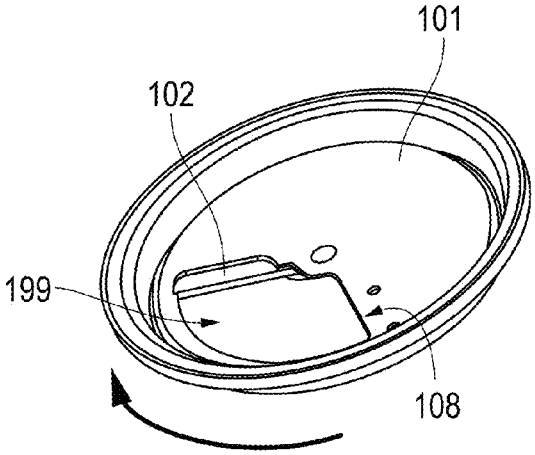
FIG. 11 shows a top view of the same embodiment of a rotating container closure of the present invention in a fully opened configuration.

Moving now to methods for operating the closure system of the present invention, various embodiments of which are shown in FIGS. 8 through 11. To open certain embodiments of the closure system described herein, a user applies force to a rotating lever 102 from its initial sealed rest position against a first edge 107 of the aperture 199. The rotating lever 102 may be configured with a thumb tab for convenience or to facilitate opening. As shown in FIG. 8, the rotating lever 102 may be rotated axially counterclockwise from its initial storage position against first edge 107. As shown in FIG. 9, the counterclockwise axial rotation is continued until the movement of the rotating lever 102 abuts against a second edge 108 of the aperture 199. As described below, at this point of travel, the bond between the end panel 101 and the cover panel 104 has been substantially broken the bond perimeter 103 and the cover panel 104 has been irreversibly affixed to the rotating lever 102. Hence, when the rotating lever 102 is positioned against the second edge 108 as shown in FIG. 9, reversing the rotation of the rotating lever 102 causes the cover panel 104 to axially rotate with the rotating lever 102 in a counterclockwise direction, progressively uncovering the aperture 199 as the rotating lever 102 and the cover panel 104 are rotated until such time as the aperture 199 is fully open at the point when the rotating lever 102 returns to the first edge 107, thereby completing the opening process. Mechanical détente features may be included in the panels to hold the cover panel 104 in a fully open position.

Thereafter, because the rotating lever 102 is affixed to the cover panel 104, the rotating lever 102 can be moved clockwise and then counterclockwise to reversibly close and open the aperture 199. Mechanical détente features (not shown) may be included in the panels to hold the cover panel 104 in a fully open, a fully closed, or an intermediate position.

While the system and method described above present one embodiment of a reclosable opening method and system of the present invention, those of ordinary skill in the art will understand that other embodiments have also been enabled. Even though the foregoing discussion has focused on particular embodiments, it is understood that other configurations are contemplated. FIGS. 12 through 15 are intended to show specific details of one such embodiment.

It should be noted that, although the method of operating described above contemplates that the rotating lever 102 may be rotated axially "counterclockwise" from its initial storage position against first edge 107, it should be appreciated that the opening system of the present invention could be configured antipodally such that a reference to a "counterclockwise" rotation would represent a clockwise rotation and vice versa. In addition, any other configurations described herein as being directional in nature should be construed to include movements in the opposite directions and should not be taken as limiting the scope of the invention.

Referring now to FIG. 12 which shows a close up view of one embodiment of the container closure show in FIG. 7 and described above. The rotating lever 102 is configured to provide force and mechanical advantage to progressively cleave and debond the joined end panel 101 from the cover panel 104. As will be understood by those skilled in the art, appropriate design parameters, materials selections, and methods must be used to assure the precise and reliable operation of the closure system.

In numerous embodiments of the present invention, the composition of the cover panel 104 and the end panel 101, as well as the interaction of the two panels with the bond between the panels and the debonding tool, are designed to provide minimal deformation so that the shape and relative position of the cover panel are maintained throughout the opening process rendering the cover panel 104 suitable for use in reclosing the aperture, if desired. For example, industry standard grades of aluminum alloys, such as aluminum 5182 alloy or aluminum 3004 alloy, in typical thicknesses of 0.20 to 0.30 mm are suitable for metal forming of the end panel 101, the rotating lever 102, and the cover panel 104. The higher stiffness of the end panel 101 and the cover panel 104 helps to retain shape integrity which, when combined with an elastomeric adhesive, can more effectively seal the cover panel to the end panel. The stiffness can further be enhanced by alloy selection, plate thickness, and the incorporation of reinforcing structures, such as incorporating grooved ribs 901 into the cover panel 104.

Referring now to FIGS. 12 and 13, wherein it can be seen that an upper end portion 557 of the rotating lever 102 located distally to the post structure 105 described earlier as a rivet preform structure extends past the rim of the aperture 199 and is positioned above the top surface of the end panel 101. This upper end portion 557 prevents deflection of the cover panel 104 downwardly through the aperture 199 into the interior of the container when the user applies force to rotate the rotating lever 102. It can also be seen that a lower distal end portion 702 of the rotating lever 102 extends past the rim of aperture 199 and is positioned below the top surface of the end panel 101. This lower distal end portion 702 is a working edge of the rotating lever 102.

Figure 14:
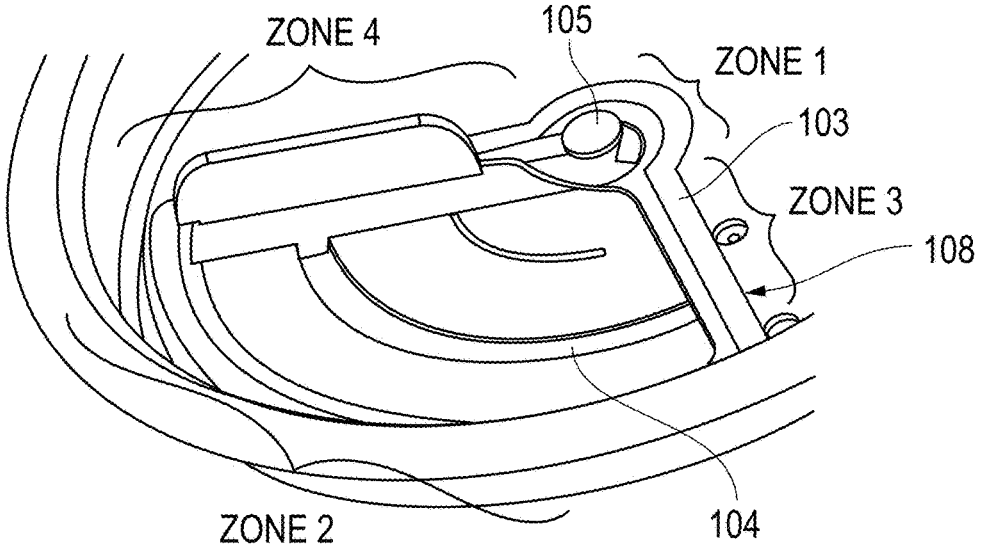
FIG. 14 shows a cutaway view of the same embodiment of a rotating container closure of the present invention with progressive sequence of debonded regions.

FIGS. 12 through 14 illustrate how operation of a movable tool sequentially cleaves and debonds the bonding perimeter 103, thereby reducing the peak and average applied force that would otherwise be required. As shown in FIG. 12, the rotating lever 102 is configured with a proximal lever 701, lower distal end portion 702 and leading edge 703, each of which will be described in more detail below.

FIG. 13 shows an area of dimensional relief 525 between the end panel 101 and the cover panel 104 that accommodates lower distal end portion 702 when the rotating lever 102 is in its sealed initial rest position against the first edge 107. Other relief features are incorporated as needed at other points in the system (for example adjacent to 701 in this embodiment) such that none of the interposed working edges of rotating lever 102 apply debonding forces in the initial sealed storage state. By design, the mechanical reliefs taper off and the working edges begin to apply increased debonding force as the rotating lever 102 rotatably moves from the first edge 107.

As is well recognized by those skilled in the art, metal beverage containers are designed to accommodate some internal pressure, the level depending on the application. Increased internal pressure may be transitory for example due to thermal processing or sustained, for example an appreciable internal pressure is often present in unopened containers of carbonated soft drinks and beer. In applications where there is sustained internal pressure, the first stage in opening a beverage container should be to relieve the internal pressure. Once this is accomplished the user force required to complete the opening operation and the potential for spraying are both reduced. SOT beverage closures are usually designed to effect a two stage opening, the first stage being release of container pressure.

The previously described embodiments accommodate preliminary relief of container internal pressure in a novel manner. Referring back to FIG. 12, as counterclockwise rotation of rotating lever 102 is initiated, the proximal lever 701 is first wedged between the end panel 101 and the cover panel 104 in the area adjacent to the post structure 105, forcing the two panels apart and debonding the region shown as Zone 1 on FIG. 14. The rotating lever 102 and the proximal lever 701 form a mechanical lever that pivots on the post structure 105 which acts as a fulcrum. Because the distance from the point at which the force is applied to the rotating lever 102 from the fulcrum is greater than the distance from the fulcrum to the point at which the proximal lever 701 is wedged between the end panel 101 and the cover panel 104, the force applied by the user to the rotating lever 102 is significantly magnified. The mechanical advantage achieved through this leverage creates the force necessary to release the internal pressure that is, in part, working to keep the container closed by forcing the cover panel 104 against the end panel 101.

Continued counterclockwise rotation from the first edge 107 toward the second edge 108 brings lower distal end portion 702 into action sweeping along the circumference of the bonding perimeter 103 to cleave the seal designated as Zone 2 in FIG. 14 by the mechanism shown in FIG. 5. The leading edge 703 of the rotating lever 102 then wedges between the end panel 101 and the cover panel 104 at the second edge 108, cleaving and debonding the connection between the panels in the region designated as Zone 3 in FIG. 14 by the mechanism shown in FIG. 4. In certain embodiments, mechanical anti-rotation features 802 in the end panel 101 prevent movement of the cover panel 104 should it be fully freed prior to a complete sweep of the rotating lever 102.

Figure 15:
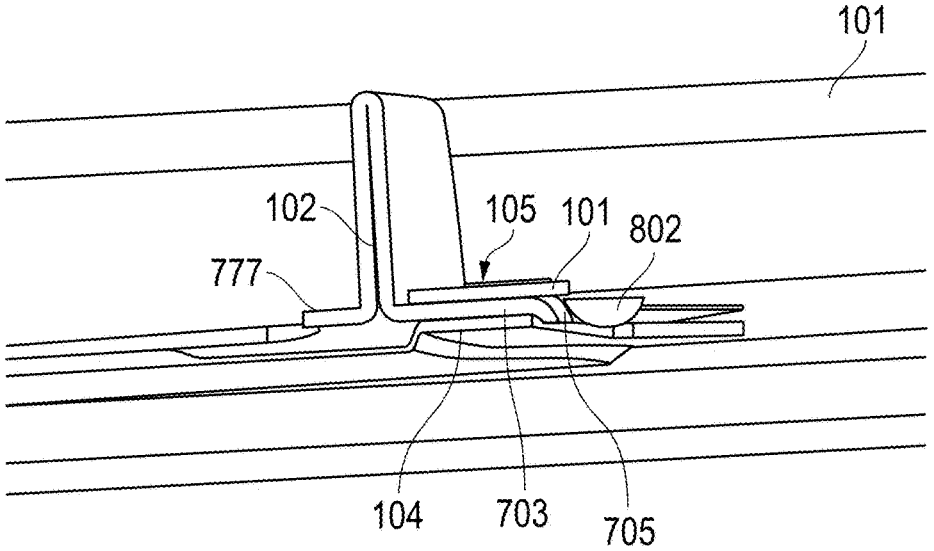
FIG. 15 shows a sectional view of the same embodiment of a rotating container closure of the present invention showing the latching of the rotating lever.

Referring now to FIG. 15, showing the rotating lever 102 stopped at the second edge 108 of the aperture 199 with its leading edge 703 fully interposed between the end panel 101 and cover panel 104. In this position, a formed pawl 705 hooks over the edge of the cover panel 104 to form a latching engagement. The rotating lever 102 is thus securely latched to the cover panel 104 such that, when the user moves the rotating tab 102 from the second edge 108 towards the first edge 107, the applied force is leveraged through the stiff cover panel to cause debonding in the region designated as Zone 4 in FIG. 14. This assures the bond between the end panel 101 and the cover panel 104 is broken along the full extent of the bonding perimeter 103 and allows movement of the cover panel 104 to open the aperture 199. Thereafter, moving the rotating lever 102 from the first edge 107 towards the second edge 108 and back again moves the cover panel 104 between fully open and fully reclosed positions. In certain embodiments, it may be necessary or desirable to have an opposed mechanical engagement to assure bidirectional movement of the cover panel 104 with the rotating lever 102.

Figure 16:
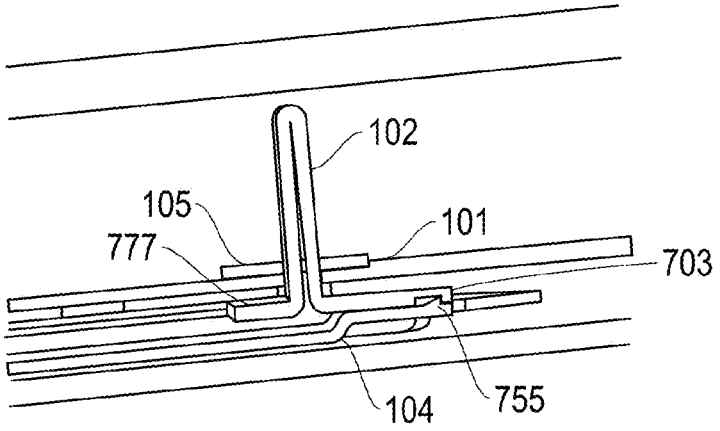
FIG. 16 shows a sectional view of the same embodiment of a rotating container closure of the present invention with an alternative latching mechanism.

For example, FIG. 16 shows an alternate latching arrangement in which the pawl 755 engages with a hole or slot in the cover panel 104 to form a bidirectional latch. Various alternative forms of simple cooperative latching mechanisms may also be used to couple the rotating lever 102 to the cover panel 104. Flat flexible spring prongs and catches, or mating peg-hole features can be readily formed in parts made of either sheet metal or molded plastic.

As will be readily apparent to those skilled in the art, variations of the foregoing embodiments are possible. For example, the arrangement of the post structure 105 used to join the end panel 101 with the cover panel 104 could alternatively project down from the underside of the end panel 101 through apertures in the rotating lever 102 and cover panel 104. Alternatively, the post structure 105 could be an entirely separate component formed from metal, plastic, other materials known in the art, or a combination thereof.

Figure 17A:
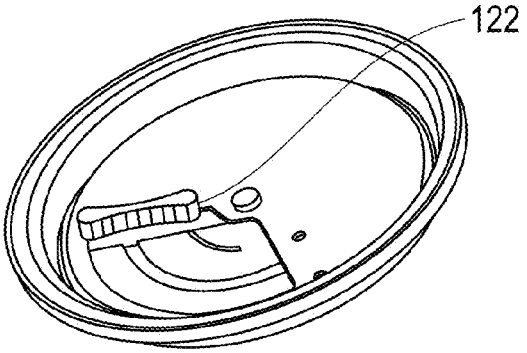
FIGS. 17A, 17B, 17C and 17D show various views of the components of the same embodiment of a rotating container closure of the present invention with an alternative rotating lever.
Figure 17B:
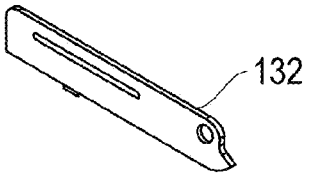
Figure 17C:
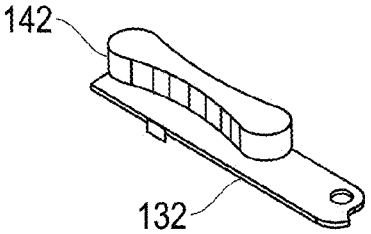
Figure 17D:
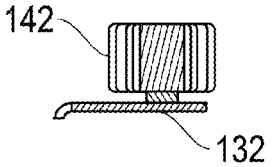

In addition, rather than aluminum sheet, the cover panel 104 and rotating lever 102 may be formed from other materials, for example molded plastic, in a variety of decorative colors, or even transparent PET for a translucent aperture cover. Logos or other graphics could be printed or formed into such components. FIG. 17A shows an alternative form of rotating tab 122 which could be made, for example, from hybrid materials. In one embodiment, a thin stiff metal, shown in FIG. 17B, forms the working edge 132 of the opening system, which, as shown in FIG. 17C and FIG. 17D, is affixed to one possible design of plastic molded handle 142 that is comfortable and easy to use. In another embodiment, the lever handle could incorporate a camlock mechanism for better resealing in the re-closed position. Formed features and components on standard or lightweight end closures may be of low profile for convenient stacking and handling in manufacture and distribution.

In addition, the working edges 701, 702, 703, 777 of the rotating lever 102 can be modified to alter its mode of action or the debonding sequence. For example, referring back to FIGS. 6 through 15, the Zone 4 bond region of FIG. 14 was the last region in sequence to be opened and was debonded by being stressed in shear through the movement of the cover panel 104 bonded to the rotating lever 102. Because the force needed for shearing an adhesive bond is higher than for cleaving, an alternative to the embodiment described in FIGS. 6 through 15 could incorporate a mechanism for first cleaving the bond in the region designated as Zone 4. In this modified embodiment, the closure system of FIG. 7 is seamed to the open upper end of the container body. A trailing edge 777 as shown in FIG. 15 of the rotating lever 102 is interposed between the end panel 101 and cover panel 104 along Zone 4. In this modified embodiment, an initial push on the handle of the rotating lever 102 causes the trailing edge 777 to rotate on an axis parallel to the plane of the panels such that a levering cam action of its base creates a cleaving stress. Further debonding steps follow as the rotating lever 102 moves from the first edge 107 to the second edge 108 and back, so that the new sequential order of debonding is: Zone 4, Zone 1, Zone 2, then Zone 3.

Alternative bonding materials and methods may be applied. For example in addition to modifying the geometric parameters for bond thickness and width, various grades of hot melt or other adhesive systems can be selected to alter the mechanical strength and barrier properties for the bonding perimeter 103 between the end panel 101 and aperture cover 104. In cases where at least one of the panels is of a thermoplastic material, thermal processing or ultrasonic welding may be used as an alternative or adjunct to an adhesive joint. If both panels are of metal, micro-spot welds could similarly be used.

Figure 18A:
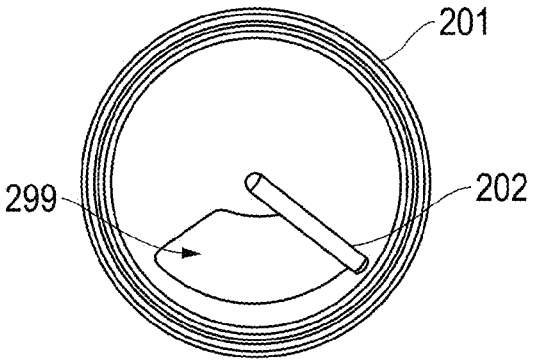
FIG. 18A shows a top view of another embodiment of a rotating container closure of the present invention.
Figure 18B:
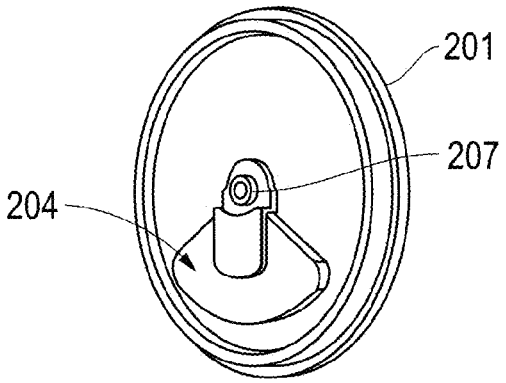
FIG. 18B shows a bottom view of the foregoing embodiment of a rotating container closure of the present invention.
Figure 18C:
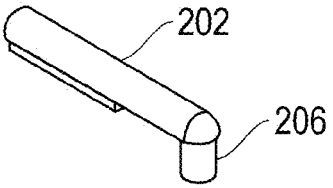
FIG. 18C shows a perspective view of the foregoing embodiment of a rotating tab of a rotating container closure of the present invention.

Referring now to FIGS. 18 through 20 which show an alternative embodiment of the present invention. FIGS. 18A and 18B show the topside and underside, respectively, of a closure assembly. Once again, the end panel 201 is a seamable container end with a generally wedge shaped aperture 299 which, in some applications, may be a pour spout. In this embodiment, the cover panel 204 has a dished shape with a flat flange area around its perimeter for sealing to the end panel 101, and its recessed depth accommodates the edge of the rotating lever 202. Rather than a rivet preform structure, the rotating lever 202 has a cylindrical end 206 retained in a cylindrical well 207 in the cover panel 204 at its pivot point. The panels in this embodiment are initially sealed and bonded together such that the end panel 201 overhangs the well in the aperture panel 204 all around its perimeter and the working edges of the rotating lever interposed under this ledge act to pry the panels apart and progressively debond the seal.

Figure 19A:
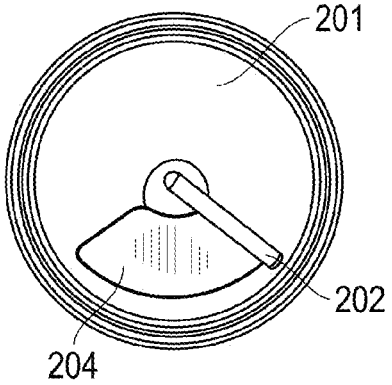
FIGS. 19A, 19B, 19C, 19D and 19E show a series of cutaway views of the foregoing embodiment of a rotating container closure of the present invention in progressive stages of opening.
Figure 19B:
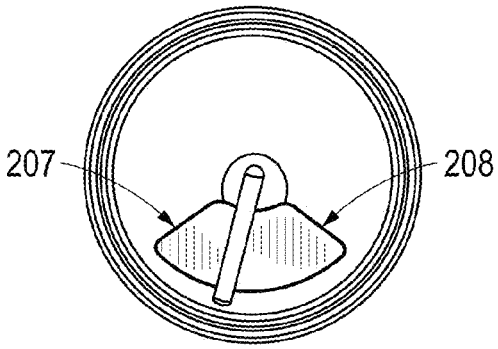
Figure 19C:
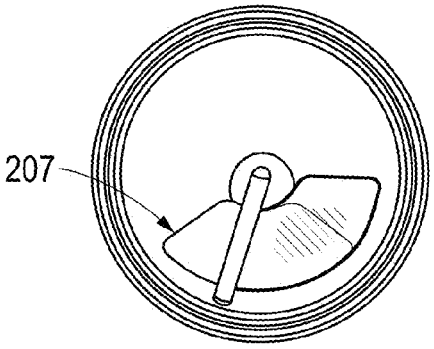
Figure 19D:
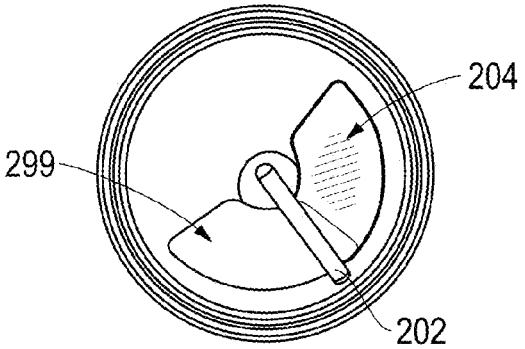
Figure 19E:
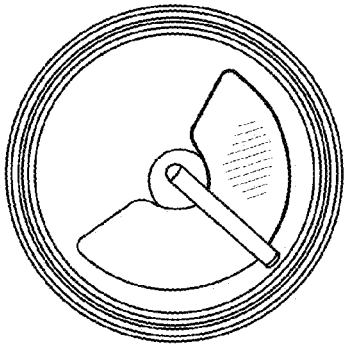

FIGS. 19A, 19B, 19C, 19D and 19E show a sequence of stages in opening and reclosing the foregoing embodiment of the container closure of the present invention. The surface of the end panel 201 is rendered transparent in all views of FIG. 19 in order to reveal the movement of the cover panel 204 beneath it. FIG. 19A shows the rotating lever 202 to be adjacent to the first edge 207 in the initial sealed state. Moving the rotating tab 202 from the first edge 207 toward the second edge 208 debonds the cover panel 204 from the end panel 201. An intermediate position between the first edge 207 and the second edge 208 is shown in FIG. 19B. Once the rotating lever 202 reaches the second edge 208, the cover panel 204 and the end panel 201 have been fully debonded, the cover panel 204 is affixed to the rotating lever 202, and, as the rotating lever begins moving back towards the first edge 207, the cover panel 204 moves in tandem with the rotating lever 202. FIGS. 19C through 19E shows the relative position of the cover panel 204 and the rotating lever 202 at short intervals after the maximum clockwise movement has fully debonded the cover panel 204 and affixed it to the rotating lever 202. The cover panel 204 rotates progressively further beneath the end panel as the size of the aperture 299 increases.

Figure 20A:
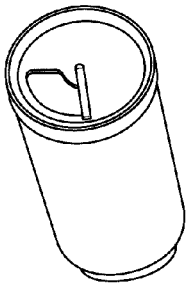
FIGS. 20A, 20B and 20C show a series of views of the foregoing embodiment of a rotating container closure of the present invention on a beverage container in progressive stages of opening.
Figure 20B:
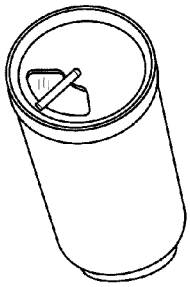
Figure 20C:
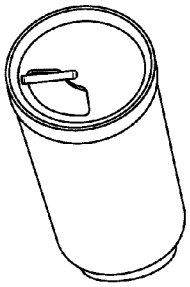

Referring now to FIGS. 20A, 20B and 20C which show various states of opening for the foregoing embodiment of the closure system seamed onto a carbonated beverage container known in the art. In FIG. 20A, the rotating lever is adjacent to the first edge and the opening system is in its initial sealed state. The opening system is partially open in FIG. 20B and nearly completely reclosed in FIG. 20C. Note that, since the rotating lever latches to the end of the cover panel that is furthest from its initial storage position (i.e. adjacent to the second edge of the aperture), its position on an apparently closed can provides tamper evidence, a visual indication of whether the container is sealed, as shown in FIG. 20A or reclosed, as shown in FIG. 20C. Additional or alternative features or components may be incorporated into the many possible embodiments to provide tamper proofing or tamper evidencing of the seal condition.

Figure 21A:
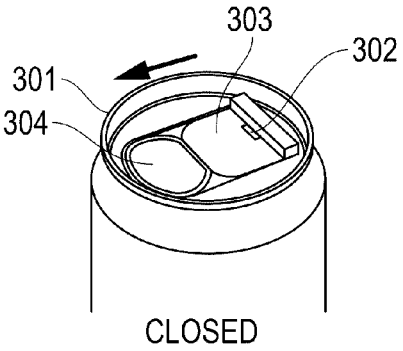
FIGS. 21A, 21B, and 21C show a series of views of one embodiment of a sliding container closure of the present invention on a beverage container in progressive stages of opening and reclosing.
Figure 21B:
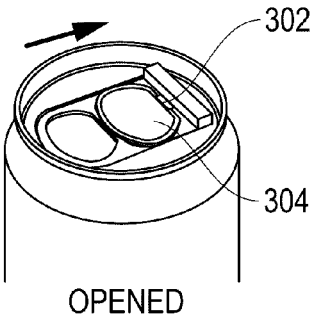
Figure 21C:
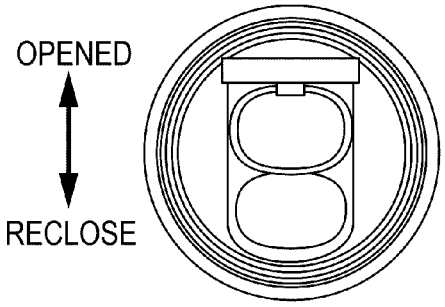

Referring now to FIGS. 21 and 22 which show yet another embodiment of the present invention in which the movable tool used to debond the end panel for the cover panel slides rather than rotates to perform its debonding function. As shown in FIG. 21, container closure end 301 is seamed onto a container known in the art. In this embodiment, the sliding panel 302 and the cover panel 304 are captured in a recessed channel formed in the topside surface of a seamed container end. The channel boundary surfaces maintain alignment of the components during use. In FIG. 21A, the opening system is initially sealed and the sliding panel 302 is behind and adjacent to the cover panel 304. As the sliding panel 302 is moved forward, the sliding panel 302 slides under the cover panel 304 and, as the bond between the end panel 301 and the cover panel 304 is debonded, the cover panel 304 preferentially affixes to the sliding panel 302. As shown in FIG. 21B, when the opening system is fully opened, the cover panel 304 is captured and held on top of the sliding panel 302. When so latched, shuttling the sliding panel 302 over or away from the aperture toggles between a reclosed or an open container as shown in FIG. 21C.

Figure 22A:
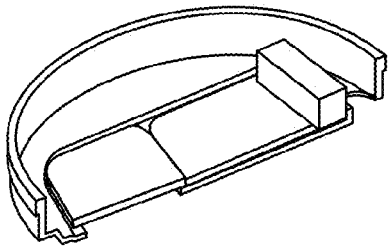
FIGS. 22A, 22B, 22C and 22D show a series of cross sectional views of one embodiment of a sliding container closure of the present invention in progressive stages of opening and reclosing.
Figure 22B:
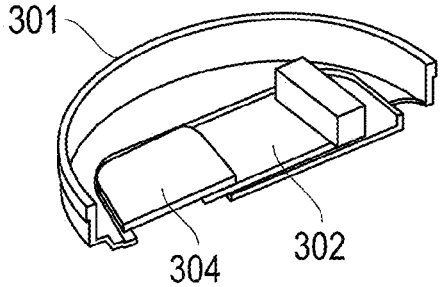
Figure 22C:
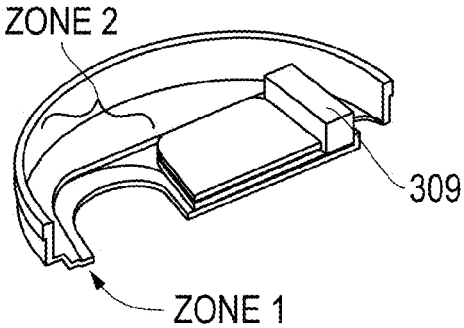
Figure 22D:
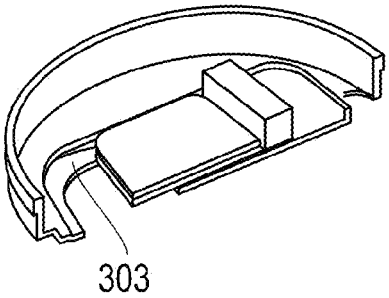

The foregoing embodiment is further illustrated in FIGS. 22A, 22B, 22C and 22D, wherein the container is initially sealed with the sliding panel 302 behind and adjacent to the cover panel 304. As the sliding panel 302 is moved toward the cover panel 304 as shown in FIG. 22B, the leading edge of the sliding panel 302 is wedged between the end panel 301 and the cover panel 304 and initiates debonding in the region designated as Zone 1 in FIG. 22C. As the sliding movement is continued and completed, working edges along the side of the sliding panel 302 debond the end panel 301 and the cover panel 304 in seal areas adjacent to the channel walls in the region designated as Zone 2 in FIG. 22C, and finally at the far end of the region designated as Zone 3 in FIG. 22C. In some embodiments, a prong 309 on the sliding panel 302 engages with the rolled edge of the cover panel 304 to affix one to the other.

Referring now to FIGS. 23A, 23B, 23C, 32D and 23E, in which the aperture 409 is an elongated channel with straight parallel sidewalls. The cover panel 404 has a recess that accommodates the opening lever 402 in the initial sealed state of the opening system. A rotating cam action of the opening system achieves an initial opening stage, for example for depressurization of the container, and this is followed by a second stage of debonding which occurs via translation of the opening lever 402 working edges along the bonded seam.

Figure 23A:
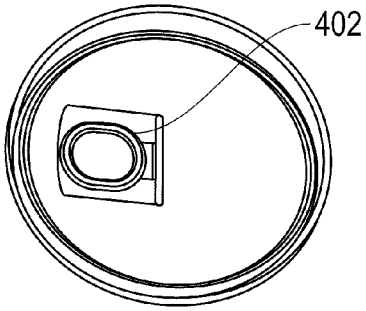
FIGS. 23A, 23B, 23C, 23D, and 23E show a variety of views of the foregoing embodiment of a sliding container closure of the present invention in progressive stages of opening.
Figure 23B:
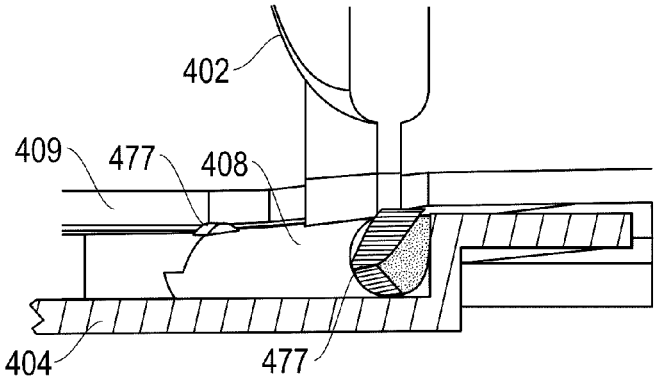
Figure 23C:
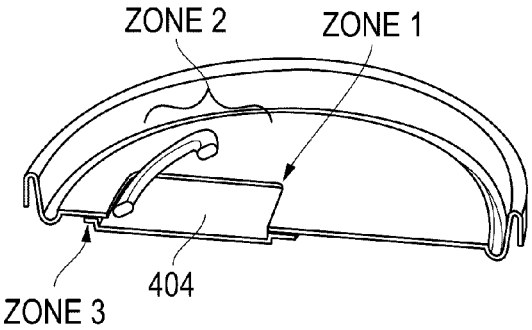
Figure 23D:
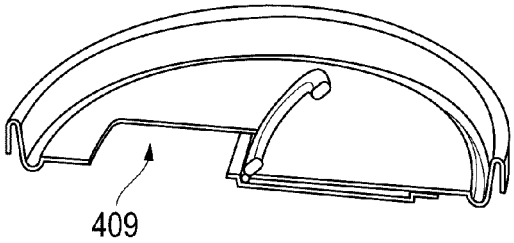
Figure 23E:
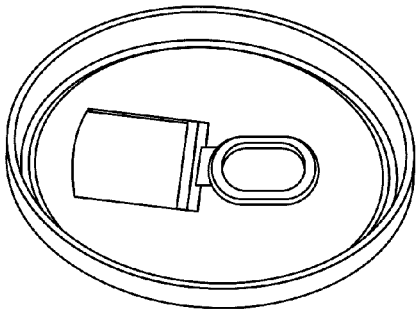

FIG. 23A shows this initial sealed state, with the opening lever 402 positioned in the cover panel 404 recess. In the expanded sectional view of FIG. 23B, the opening lever 402 has been rotated upward. This movement of the opening lever 402 causes cam elements 477 on the ends of its perpendicular cylindrical base 408 to rotate into contact with an overhanging edge of the end panel 401 such that a localized separating force acts to debond a short section of the seam between the end panel 401 and the cover panel 404. A small opening will permit equalization of pressure between the inside the container and the surroundings, thereby reducing the force needed to continue opening the opening system. Using the opening lever 402 as a handle to force its cylindrical base 408 along the cover panel 404 recess, imposes the formed ends of the base as working edges through a tapering gap between the end panel 401 and cover panel 404. When the cylindrical base 408 reaches the far end of the cover panel 404 recess as shown in FIG. 23C, the seam in that vicinity may be debonded using cam action via another partial rotation of the opening lever 402 about its base. The cylindrical base 408 of the tool simultaneously engages a groove in the cover panel 404 and is latched to it at the endpoint of the cover panel 404 recess. The aperture 409 can be fully opened and then held in place by pulling the opening lever 402 back down the cover panel 404 recess and folding it down onto the surface of the end panel 401.

Figure 24A:
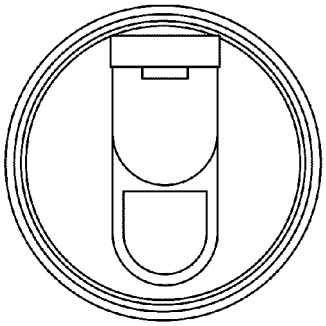
FIGS. 24A and 24B show alternative configurations of container openings in various embodiments of the present invention.
Figure 24B:
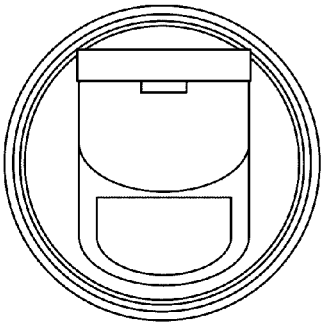
Figure 25A:
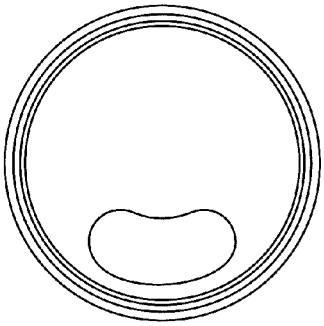
FIGS. 25A, 25B and 25C show other alternative configurations of container openings in various embodiments of the present invention.

In addition to the foregoing, those skilled in the art will recognize that alternative embodiments of the invention described herein are possible. For example, FIGS. 24 through 26 illustrate a wide variety of possible aperture configurations for food or beverage applications utilizing various embodiments of the present invention. The opening system of the present invention may be used with the generally elongated oval pouring aperture known in the art and shown in FIG. 25A, as well as many other configurations, that may be desirable to customize the appearance, or the opening or dispensing characteristics, of the aperture. Moreover, specially shaped aperture openings can be closed by a movable cover panel, which need not conform to the same outline as the aperture, yet provides full coverage of the aperture with sufficient edge area for a bonding seam.

Figure 25B:
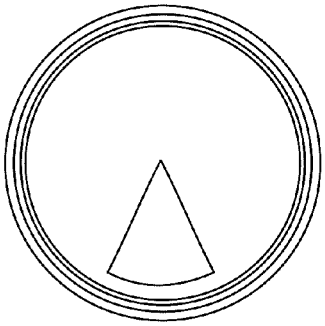
Figure 25C:
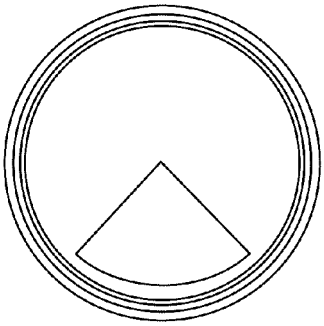
Figure 26A:
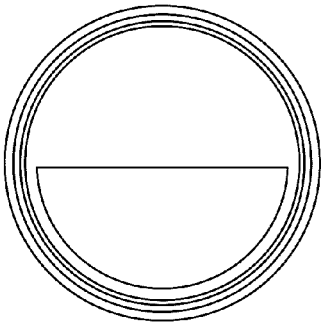
FIGS. 26A, 26B and 26C show further alternative configurations of container openings in various embodiments of the present invention.
Figure 26B:
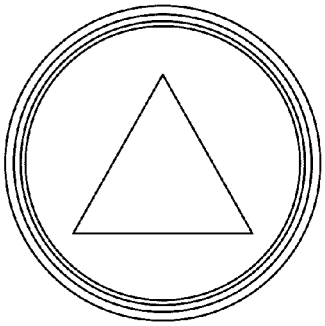
Figure 26C:
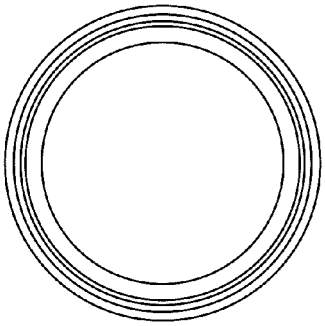

Larger apertures for beverage containers are often preferred by consumers and the opening system of the present invention allows for a generally wedge shaped partial aperture opening with a center angle of anywhere from 1 to 180 degrees as shown in FIGS. 25B, 25C and 26A. Also, in certain embodiments, the center of rotation of the cover panel can either be common with, or offset from the end panel center as shown in FIG. 26B. The range of possible configurations extends beyond partial openings to full open aperture as shown in FIG. 26C.

Figure 27:
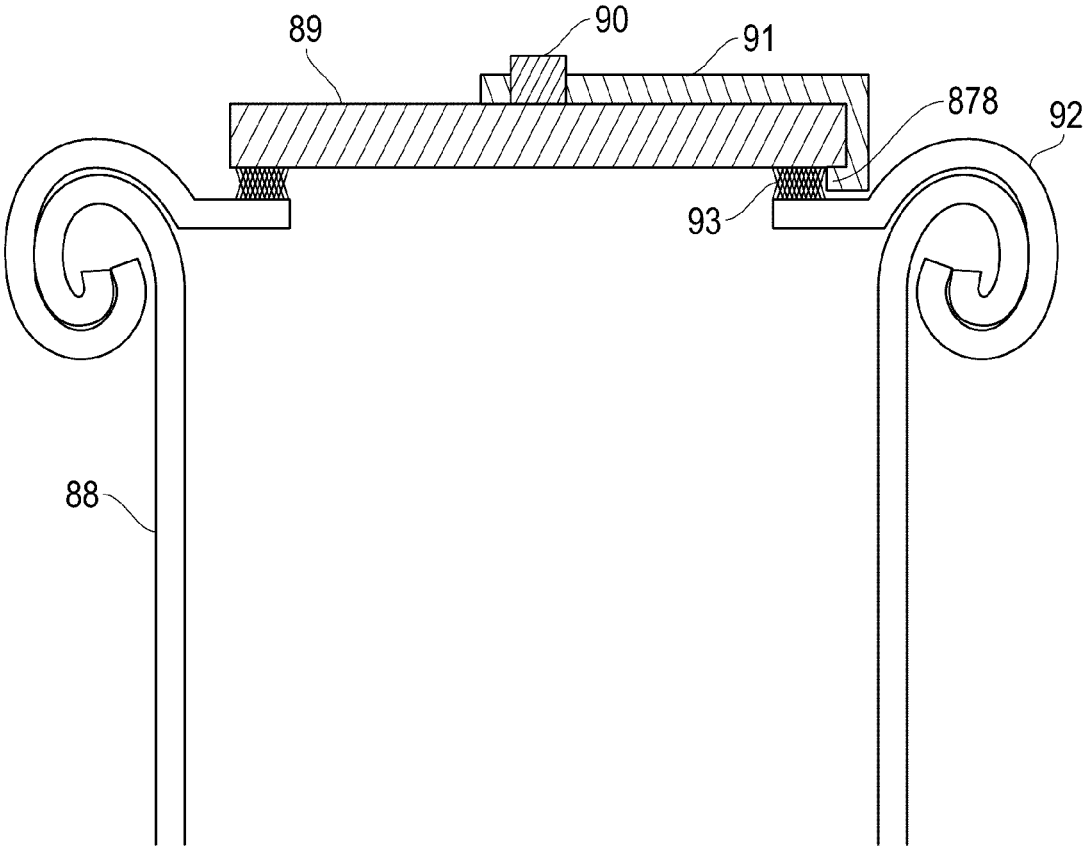
FIG. 27 shows a full open aperture used in various embodiments of the present invention.

FIG. 27 shows an embodiment of a full open aperture container in which an end panel 92 is seamed onto a can body 88. In previously described embodiments of partial aperture closures, the cover panel 89 was on the inside wall of the end panel 92, however internal or external placements are suitable alternatives for full or partial closure systems. In all cases, however, at least a portion of the lever or debonding tool should be accessible to the user.

Referring again to FIG. 27 wherein the cover panel 89 is outside the end panel 92 in order to permit the end panel 92 of opened closure to be readily removed. The movable tool 91 remains affixed to the cover panel 89 cap by a post structure 90 around which the cover panel 89 can pivot. A single working edge 878 of the movable tool 91 is interposed between the end panel 92 and the cover panel 89 in the region of the bonded seam. The tool 91 can be rotated partially to equalize pressure differential and then to complete one full revolution from the initial storage position so that the working edge moves around the circumference acting on the outer perimeter of the adhesive loop to debond the joint.

After the seal has been fully debonded, the container is opened by lifting or removing the cover panel 89, possibly using the attached debonding tool 91 as a form of handle. The cover panel may be hinged to the container or removed completely but in either case retains its form so as to be suitable for reclosing the container. Thus, the cover panel 89 may provide a reseatable cap for the container. To provide rigidity, the cover panel 89 and end panel 92 may have rolled perimeter edges or rib features. Rather than attaching the debonding tool or lever 91 to the cover panel 89, the tool 91 may be coupled to a fitted plastic overcap. Alternatively, the working edges of the debonding tool 91 could be molded directly into the interior circumference of a fitted plastic overcap arranged so that they are initially sprung outwards and squeezing the edge of the cap forces them in to engage and debond the seal.

While the present system and method has been disclosed according to the preferred embodiment of the invention, those of ordinary skill in the art will understand that other embodiments have also been enabled. Even though the foregoing discussion has focused on particular embodiments, it is understood that other configurations are contemplated. In particular, even though the expressions "in one embodiment" or "in another embodiment" are used herein, these phrases are meant to generally reference embodiment possibilities and are not intended to limit the invention to those particular embodiment configurations. These terms may reference the same or different embodiments, and unless indicated otherwise, are combinable into aggregate embodiments. The terms "a", "an" and "the" mean "one or more" unless expressly specified otherwise. The term "connected" means "communicatively connected" unless otherwise defined.

When a single embodiment is described herein, it will be readily apparent that more than one embodiment may be used in place of a single embodiment. Similarly, where more than one embodiment is described herein, it will be readily apparent that a single embodiment may be substituted for that one device.

In light of the wide variety of reclosable container opening systems known in the art, the detailed embodiments are intended to be illustrative only and should not be taken as limiting the scope of the invention. Rather, what is claimed as the invention is all such modifications as may come within the spirit and scope of the following claims and equivalents thereto.

None of the description in this specification should be read as implying that any particular element, step or function is an essential element which must be included in the claim scope. The scope of the patented subject matter is defined only by the allowed claims and their equivalents. Unless explicitly recited, other aspects of the present invention as described in this specification do not limit the scope of the claims.

What is claimed is:

1. A container opener, comprising:

an end panel;

a cover panel covering an aperture through the end panel, the cover panel extending beyond the aperture to form a perimeter area around the aperture, the perimeter area being removably bonded to the end panel; and a lever movably attached to the end panel and the cover panel, wherein the lever is configured to selectively debond the cover panel from the end panel, wherein the lever is initially positioned against a first edge of the aperture such that the perimeter is fully bonded to the end panel and, as the lever is moved away from the first edge towards a second edge of the aperture, the lever debonds a portion of the perimeter area while leaving the cover panel substantially in place.

2. The container opener of claim 1, wherein the lever selectively debonds the cover panel from the end panel by cleaving the bond between the cover panel and the end panel.

3. The container opener of claim 1, wherein the cover panel is positioned on the underside of the end panel and a portion of the lever is positioned on the underside of the end panel and configured to debond at least a portion of the perimeter area as the lever is moved.

4. A container opener, comprising:

an end panel;

a cover panel covering an aperture through the end panel, the cover panel extending beyond the aperture to form a perimeter area around the aperture, the perimeter area being removably bonded to the end panel; and a lever movably attached to the end panel and the cover panel, wherein the lever is configured to selectively debond the cover panel from the end panel, wherein the lever is initially positioned against a first edge of the aperture such that the perimeter is fully bonded to the end panel and, as the lever is moved away from the first edge towards a second edge of the aperture, the lever debonds a portion of the perimeter area while leaving the cover panel substantially in place, and wherein, as the lever arrives at the second edge of the aperture, the lever is affixed to the cover panel so that, as the lever is moved from the second edge back towards the first edge, the cover panel moves with the lever, thereby displacing the cover panel from the aperture.

5. A container opener, comprising:

an end panel;

a cover panel covering an aperture through the end panel, the cover panel extending beyond the aperture to form a perimeter area around the aperture, the perimeter area being removably bonded to the end panel; and a lever movably attached to the end panel and the cover panel, wherein the lever is configured to selectively debond the cover panel from the end panel, wherein the lever is initially positioned against a first edge of the aperture such that the perimeter is fully bonded to the end panel and, as the lever is moved away from the first edge towards a second edge of the aperture, the lever debonds a portion of the perimeter area while leaving the cover panel substantially in place, and wherein, as the lever arrives at the second edge of the aperture, the lever is affixed to the cover panel so that, as the lever is moved from the second edge back towards the first edge, the cover panel moves with the lever, thereby displacing the cover panel from the aperture, and wherein the cover panel thereafter remains affixed to the lever so that, as the lever is again moved from the first edge to the second edge, the cover panel forms a seal over the aperture.

6. The container opener of claim 1, wherein the initial force required to move the lever away from the first edge does not exceed fifteen lbf.

7. The container opener of claim 1, wherein the container is a beverage container and the closure comprises a seamable end panel.

8. The container opener of claim 1, wherein the lever is configured in the end panel of a first container so that a similarly configured second container may be stacked on top of the first container without leaning or overturning.

9. A container opener, comprising:

an end panel;

a cover panel covering an aperture through the end panel and extending beyond the aperture to form a perimeter area around the aperture, the perimeter area being removably bonded to the end panel;

a lever attached to and pivoting axially around at least a portion of a center structure positioned at or near the center point of the end panel, the lever being further movably attached to the end panel and the cover panel; and wherein the lever is initially positioned against a first edge of the aperture such that the perimeter is fully bonded to the end panel and, as the lever is moved away from the first edge towards a second edge of the aperture, the lever debonds a portion of the perimeter area while leaving the cover panel substantially in place.

10. The container opener of claim 9, wherein, as the lever arrives at the second edge of the aperture, the lever is affixed to the cover panel so that, as the lever is moved from the second edge back towards the first edge, the cover panel moves with the lever, thereby displacing the cover panel from the aperture.

11. The container opener of claim 9, wherein, as the lever arrives at the second edge of the aperture, the lever is affixed to the cover panel so that, as the lever is moved from the second edge back towards the first edge, the cover panel moves with the lever, thereby displacing the cover panel from the aperture, and wherein the cover panel thereafter remains affixed to the lever so that, as the lever is again moved from the first edge to the second edge, the cover panel forms a seal over the aperture.

12. The container opener of claim 9, wherein as the lever arrives at the second edge of the aperture, the lever becomes affixed to the cover panel so that, as the lever is moved from the second edge back towards the first edge, the cover panel moves with the lever, thereby displacing the cover panel from the aperture and wherein the cover panel thereafter remains affixed to the lever so that, as the lever is again moved from the first edge to the second edge, the cover panel forms a seal over the aperture, and wherein the end panel is configured with a structure to hold the lever and cover panel in the closed position when pressed against the first edge or to hold the lever and the cover panel in the open position when pressed against the second edge.

13. The container opener of claim 9, wherein the lever makes at least a partial rotation around the center structure.

14. The container opener of claim 9, wherein the initial force required to move the lever away from the first edge does not exceed fifteen lbf.

15. The container opener of claim 9, wherein the cover panel is positioned on the underside of the end panel, and a portion of the lever is positioned on the underside of the end panel and configured to debond at least a portion of the perimeter area as the lever is moved from the first edge towards the second edge.

16. The container opener of claim 9, wherein the lever has a first portion extending along the first edge of the aperture and a second portion extending generally perpendicular therefor configured adjacent to the center structure and, as the lever is moved away from the first edge towards the second edge through the application of force to the first portion of the lever, the second portion debonds at least a portion of the perimeter area, thereby releasing pressure in the container.

17. The container opener of claim 9, wherein the lever has a first portion extending along the first edge of the aperture and a second portion extending generally perpendicular therefor configured adjacent to the center structure and, as the lever is moved away from the first edge towards the second edge through the application of force to the first portion of the lever, the second portion debonds at least a portion of the perimeter area, thereby releasing pressure in the container, and as the lever continues its movement from the first edge towards the second edge, the lever continues to debond portions of the perimeter area.

18. The container opener of claim 9, wherein the container is a beverage container and the closure comprises a seamable end panel.

19. The container opener of claim 9, wherein the aperture encompasses up to 50% of the surface area of the end panel.

20. The container opener of claim 9, wherein the aperture encompasses 100% of the surface area of the end panel so that the first edge of the aperture and the second edge of the aperture are the same, and rotation of the lever from the first edge to the second edge results in the detachment of the entire end panel from the container.

21. The container opener of claim 9, wherein as the lever arrives at the second edge of the aperture, the lever becomes affixed to the cover panel so that, as the lever is moved from the second edge back towards the first edge, the cover panel moves with the lever, thereby displacing the cover panel from the aperture, and the cover panel is formed of a material with sufficient structural strength to preserve its relative shape during opening so that if the lever is again moved from the first edge to the second edge, the cover panel covers the entire aperture.

22. The container opener of claim 9, wherein the lever is configured in the end panel of a first container so that a similarly configured second container may be stacked on top of the first container without leaning or overturning.

23. A method for opening a container, comprising:

covering an aperture through an end panel with a cover panel, the cover panel extending beyond the aperture to form a perimeter area around the aperture;

removably bonding the perimeter area to the end panel;

attaching a rotatable lever to at least a portion of a structure at or near the center point of the end panel, and further movably attaching the lever to the end panel and the cover panel;

initially positioning the lever against a first edge of the aperture such that the perimeter is fully bonded to the end panel; and moving the lever away from the first edge towards a second edge of the aperture, thereby debonding a portion of the perimeter area while leaving the cover panel substantially in place.

24. The method of opening a container of claim 17, wherein as the lever arrives at the second edge of the aperture, the lever becomes affixed to the cover panel so that, as the lever is moved from the second edge back towards the first edge, the cover panel moves with the lever, thereby displacing the cover panel from the aperture.

25. The method of opening a container of claim 17, wherein as the lever arrives at the second edge of the aperture, the lever becomes affixed to the cover panel so that, as the lever is moved from the second edge back towards the first edge, the cover panel moves with the lever, thereby displacing the cover panel from the aperture and wherein the cover panel thereafter remains affixed to the lever so that, as the lever is again moved from the first edge to the second edge, the cover panel forms a seal over the aperture, and wherein the end panel is configured to provide a structure to hold the lever and cover panel in the closed position when pressed against the first edge or to hold the lever and the cover panel in the open position when pressed against the second edge.

* * * * *